US005954475A

United States Patent [19]

Matsuura et al.

[11] Patent Number: 5,954,475

[45] Date of Patent: Sep. 21, 1999

[54] GAS TURBINE STATIONARY BLADE

[75] Inventors: Masaaki Matsuura; Kiyoshi Suenaga; Kazuo Uematsu, all of Takasago, Japan

[73] Assignee: Mitsubishi Jukogyo Kabushiki Kaisha, Tokyo, Japan

[21] Appl. No.: 08/913,077

[22] PCT Filed: Dec. 19, 1996

[86] PCT No.: PCT/JP96/03696

§ 371 Date: Sep. 8, 1997

§ 102(e) Date: Sep. 8, 1997

[87] PCT Pub. No.: WO97/25522

PCT Pub. Date: Jul. 17, 1997

[30] Foreign Application Priority Data

Jan. 8, 1996 [JP] Japan ..... 8-749

[51] Int. Cl.[6] ..... F01D 5/18

[52] U.S. Cl. ..... 415/115; 415/114; 415/116; 416/95; 416/96 R; 416/96 A; 416/97 R

[58] Field of Search ..... 415/115, 114, 415/116; 416/95, 96 A, 96 R, 97 R

[56] References Cited

U.S. PATENT DOCUMENTS

| | | | |
|---|---|---|---|
| 4,712,979 | 12/1987 | Finger | 416/96 R |
| 5,320,483 | 6/1994 | Cunha et al. | 415/114 |
| 5,320,485 | 6/1994 | Bourguignon et al. . | |
| 5,340,274 | 8/1994 | Cunha et al. | 415/114 |

FOREIGN PATENT DOCUMENTS

| | | |
|---|---|---|
| 0 543 627 | 5/1993 | European Pat. Off. . |
| 0 698 723 | 2/1996 | European Pat. Off. . |
| 2 712 629 | 5/1995 | France . |
| 2-241902 | 9/1990 | Japan . |
| 4-311604 | 11/1992 | Japan . |
| 5-65802 | 3/1993 | Japan . |
| 6-257405 | 9/1994 | Japan . |
| 8-28205 | 1/1996 | Japan . |

*Primary Examiner*—F. Daniel Lopez
*Assistant Examiner*—Ninh Nguyen
*Attorney, Agent, or Firm*—Wenderoth, Lind & Ponack, L.L.P.

[57] ABSTRACT

A gas turbine stationary blade, having a simple structure in which sufficient cooling is achieved and the drop in pressure of cooling vapor is decreased so that the turbine efficiency is prevented from lowering. The shape of a vapor passage is simplified to prevent the drop in pressure because an outer shroud (3) of the stationary blade and a blade unit (2) are cooled with vapor, while an inner shroud (4) is cooled with the air supplied from another system.

6 Claims, 2 Drawing Sheets

GAS TURBINE STATIONARY BLADE

BACKGROUND OF THE INVENTION

1. Field of the Invention

The present invention relates to a gas turbine stationary blade which enables cooling without a pressure drop of the cooling vapor by the use of a simple structure.

2. Description of the Prior Art

As a recent tendency of industrial gas turbine, a turbine inlet gas temperature is gradually increased to obtain a high output and high efficiency. The temperature is now anticipated to reach as high as 1,500° C. Therefore, a gas turbine stationary blade is sometimes cooled by the use of vapor (steam), having a high cooling effect, which flows within the blade. One example of a prior art cooling structure for a gas turbine stationary blade by way of vapor cooling is shown in FIGS. 3 and 4. The cooling vapor, supplied from a cooling vapor inlet 5 of an outer shroud 3, (as shown by arrows) passes through an impingement plate 13 having a multitude of fine holes and then passes through an inward cooling passage 7 within a blade unit 2 to cool a blade face. Then, it enters a finned internal cooling passage 9 (provided within an inner shroud 4*a*) to cool the inner shroud 4*a*. Next, the cooling vapor passes through an outward cooling passage 8 within the blade unit 2 to be discharged outside of a cooling vapor outlet 6 of the outer shroud 3 and to be collected in its entire amount.

In the prior art gas turbine stationary blade employing vapor cooling (as shown in FIGS. 3 and 4), the inner shroud 4*a*, through which the cooling vapor flows from the inward cooling passage 7 within the blade unit 2 to the outward cooling passage 8, has a complicated cooling passage configuration. There is a difficulty in the art of manufacture thereof, which leads to a problem of high cost. Also, there is a problem of a large pressure drop of the cooling vapor when it passes through a narrow portion of the inner shroud 4*a*, which leads to lowering of gas turbine efficiency.

SUMMARY OF THE INVENTION

It is therefore an object of the present invention to provide a gas turbine stationary blade which is able to solve the problems in the prior art.

The present invention provides a gas turbine stationary blade which has a feature that an outer shroud and a blade unit are cooled by vapor and an inner shroud is cooled by air.

In the gas turbine stationary blade according to the present invention, the outer shroud and the blade unit are cooled by vapor and the inner shroud is cooled by air supplied from another system. Consequently cooling of the shroud and the blade unit can be done effectively. Further, the cooling vapor simply enters to flow through an inward cooling passage and turns to flow through an outward cooling passage without flowing within the inner shroud. Therefore, the cooling passages through which the vapor flows can be made in a simplified configuration, and the cooling of the blade unit and the outer shroud can be achieved with less pressure drop and with a simple return flow passage.

DESCRIPTION OF THE PREFERRED EMBODIMENTS

Figure 1:
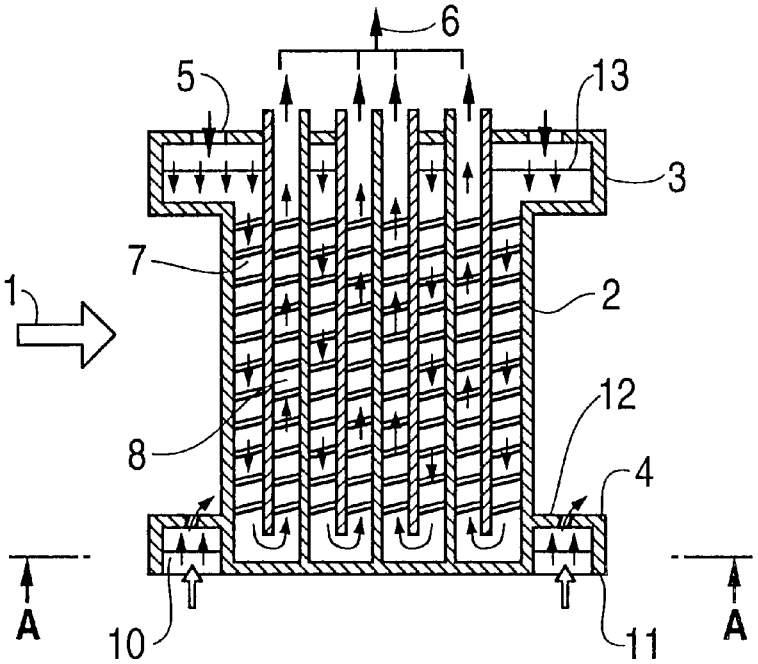
FIG. 1 is a longitudinal cross sectional view of a gas turbine stationary blade of one embodiment according to the present invention.
Figure 2:
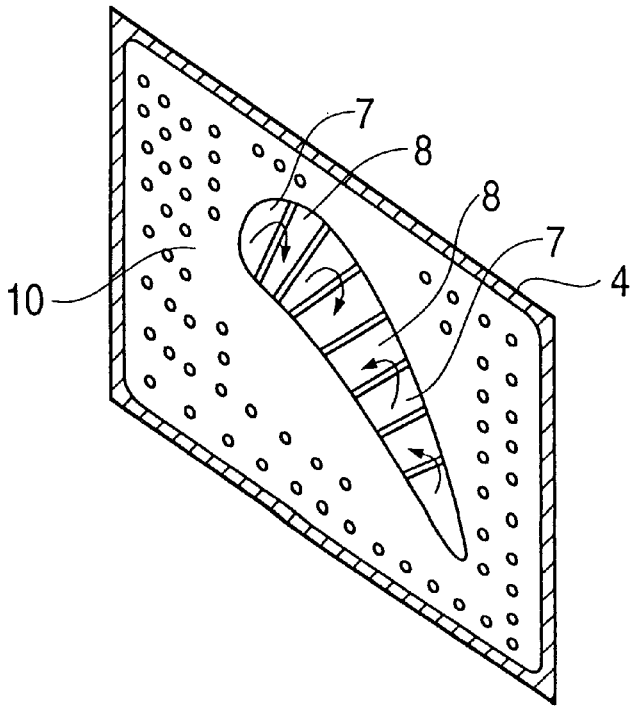
FIG. 2 is a cross sectional view taken on line A—A of the gas turbine stationary blade of FIG. 1.
Figure 3:
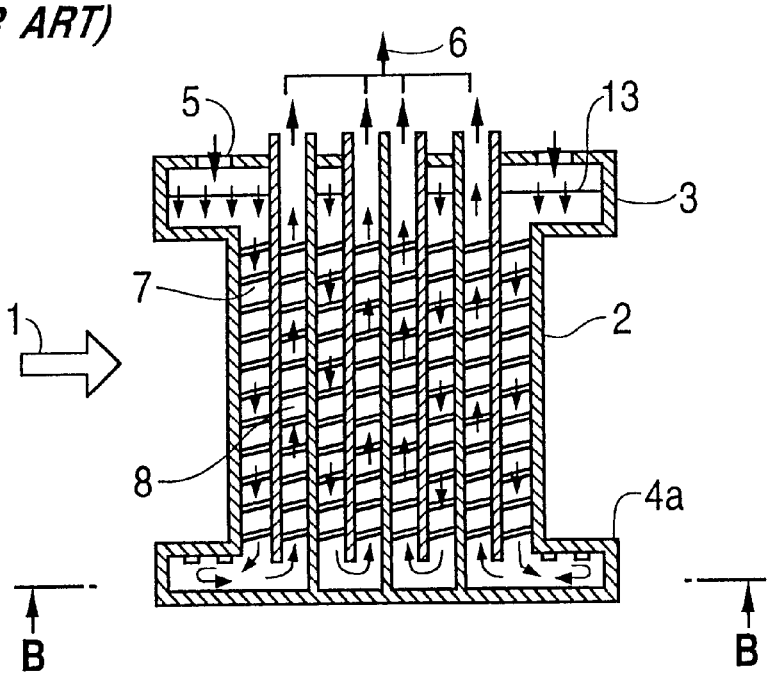
FIG. 3 (PRIOR ART)
FIG. 3 is a longitudinal cross sectional view of a prior art gas turbine stationary blade employing vapor cooling.
Figure 4:
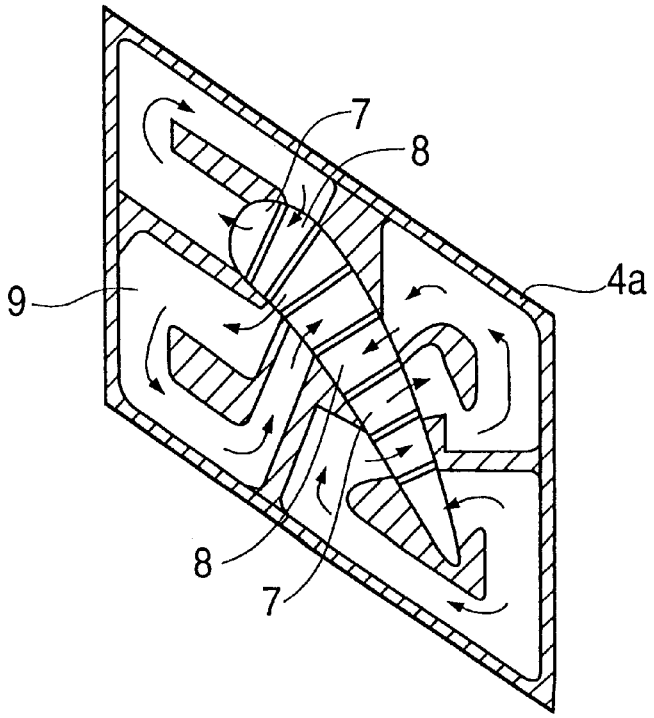
FIG. 4 (PRIOR ART)
FIG. 4 is a cross sectional view taken on line B—B of the prior art gas turbine stationary blade of FIG. 3.

One embodiment according to the present invention is described with reference to FIGS. 1 and 2. A vapor cooling structure of an outer shroud 3 and a blade unit 2 in the present embodiment is nearly the same as that in the prior art shown in FIGS. 3 and 4. A cooling vapor supplied into the outer shroud 3 from a cooling vapor inlet 5 cools the outer shroud 3 and the blade unit 2, as described herebelow. The cooling vapor is then discharged outside of a cooling vapor outlet 6 to be collected in its entire amount. A different point in the present invention, however, is such that a cooling vapor passage at an inner shroud 4 portion is structured as a simple return type in which it simply turns from an inward cooling passage 7 within the blade unit 2 to an outward cooling passage 8. There is provided no such finned internal passage 9 as shown in FIGS. 3 and 4 within the inner shroud 4. That is, the structure is made so that the cooling vapor is not introduced into the inner shroud 4.

Cooling of the inner shroud 4 is done such that air, extracted partially from combustion air, is introduced into a cooling air inlet 11 of an inner side. The air is then caused to pass through an impingement plate 10 which is provided with a multitude of fine cooling holes, and is blown against a shroud inner face to cool a shroud metal. Also, the inner shroud 4 is provided on its surface with a multitude of cooling film holes 12. The cooling air which has cooled the shroud metal of the inner shroud 4 is blown into a main gas from the cooling film holes 12 so as to create a cooling film in which the shroud surface of the inner shroud 4 is shielded against a high temperature air by a low temperature air.

In the present embodiment as so constructed, at the inner shroud 4, a desired cooling effect is obtained with a very small amount of air. Furthermore, the vapor for cooling the blade unit 2 flows only in a simple return type passage provided within the blade unit 2. Thus the pressure drop of the vapor flow can be suppressed to a minimum.

INDUSTRIAL APPLICABILITY

In the vapor cooled stationary blade according to the present invention, as set forth in claims, only the inner shroud is cooled by air and no such complicated cooling structure as in the prior art is used. Thus, pressure drop of the cooling vapor is mitigated. Consequently, while the necessary cooling effect is not damaged, lowering of the gas turbine efficiency can be avoided and the manufacturing cost can be reduced.

What is claimed is:

1. A gas turbine stationary blade comprising:

an outer shroud having a cooling vapor inlet and a cooling vapor outlet;

an inner shroud cooled by air; and a blade unit having an inward cooling passage and an outward cooling passage, wherein a cooling vapor supplied from said cooling vapor inlet flows through said inward cooling passage and turns to flow through said outward cooling passage to said cooling vapor outlet without passing through said inner shroud.

2. The stationary blade of claim 1, wherein said inner shroud has a cooling air inlet and a plurality of cooling film holes, wherein cooling air enters said inner shroud through said cooling air inlet and exits said inner shroud through said plurality of cooling film holes such that a cooling film is formed to shield said inner shroud from high temperature air.

3. The stationary blade of claim 2, wherein said inner shroud further includes an air impingement plate having a plurality of cooling holes, wherein the cooling air flows through said cooling holes and onto an inner surface of said inner shroud to cool said inner shroud.

4. A gas turbine stationary blade comprising:

an outer shroud having a cooling vapor inlet and a cooling vapor outlet;

an inner shroud cooled by air; and a blade unit connecting said inner shroud and said outer shroud, said blade unit having an inward cooling passage communicating with said cooling vapor inlet and an outward cooling passage communicating with said cooling vapor outlet, wherein said inward cooling passage communicates with said outward cooling passage such that a cooling vapor supplied from said cooling vapor inlet flows through said inward cooling passage and turns to flow through said outward cooling passage to said cooling vapor outlet without passing through said inner shroud.

5. The stationary blade of claim 4, wherein said inner shroud has a cooling air inlet and a plurality of cooling film holes, wherein cooling air enters said inner shroud through said cooling air inlet and exits said inner shroud through said plurality of cooling film holes such that a, cooling film is formed to shield said inner shroud from high temperature air.

6. The stationary blade of claim 5, wherein said inner shroud further includes an air impingement plate having a plurality of cooling holes, wherein the cooling air flows through said cooling holes and onto an inner surface of said inner shroud to cool said inner shroud.

* * * * *